US006101635A

United States Patent [19]

Jones

[11] Patent Number: 6,101,635

[45] Date of Patent: Aug. 15, 2000

[54] WOMEN'S STOCKING AND SUPPORT

[76] Inventor: Alma M. Jones, Rural Route 5, Flesherton 133541, Ontario, Canada, N0C 1E0

[21] Appl. No.: 09/346,644

[22] Filed: Jul. 1, 1999

[51] Int. Cl.[7] ..... A41B 11/00

[52] U.S. Cl. ..... 2/240; 2/239

[58] Field of Search ..... 450/100, 110, 450/111; 2/107, 109, 112, 409, 239, 240, 241, 242, 303, 306, 319, 335

[56] References Cited

U.S. PATENT DOCUMENTS

| | | | |
|---|---|---|---|
| 364,650 | 6/1887 | Holmes | 2/240 |
| 3,362,029 | 1/1968 | Comerma | 2/240 |
| 3,440,665 | 4/1969 | Russel | 2/240 |
| 4,424,596 | 1/1984 | Jackson | 2/240 |
| 5,027,441 | 7/1991 | Wilson | 2/240 |
| 5,345,613 | 9/1994 | Jones | 2/240 |
| 5,708,987 | 1/1998 | Matthews | 2/409 |

*Primary Examiner*—John J. Calvert
*Assistant Examiner*—Alissa L. Hoey
*Attorney, Agent, or Firm*—Malin, Haley & DiMaggio, P.A.

[57] ABSTRACT

This invention relates to an improved women's stocking and stocking support that utilizes a stocking support belt encircling the hip area of the wearer having only one affixing point on each side and a pair of normally cut (elongated to the wearer's crotch) individual stockings, each of which is made of a stretchable nylon material, wherein each stocking is affixed, via stitching, to the outside hip area so that the stockings may be held in place comfortably for long, extended wear while remaining, because of the stretchability of the material, firmly and attractively in place between the crotch area of the wearer, the leg portions, and the hip areas. Other articles of clothing such as tank tops or bodysuits can also be used as support members for the stretchable hose.

7 Claims, 3 Drawing Sheets

WOMEN'S STOCKING AND SUPPORT

BACKGROUND OF THE INVENTION

1. Field of the Invention

This invention relates to an improvement in women's hosiery, and in particular, to improved women's sheer stockings and a support system for increased extended wear comfort and economical manufacture. The invention is comprised of individual spandex fiber, nylon or nylon-like fabric stockings, of crotch length, each individually affixed at a single side point in the hip area to a garter belt for stocking support to allow for extended wear comfort, while covering the leg areas, full length, up to the crotch and hip.

2. Description of the Prior Art

The use of sheer stockings by women, such as "nylons," has been well known for many years. Nylon itself is any of a family of high strength, resilient, synthetic materials, the long chain molecules of which contain a recurring amide group CONH. Cloth or thread can be described as nylon and it has various degrees of sheerness. At the present time, women's stockings can be made of nylon or a similar synthetic fabric and still be called nylons. Spandex fiber is very suitable for women's stockings.

For many years, women's sheer stockings have been supported by garter belts. The primary drawback of garter belts are that they include a plurality of rigid fasteners that could contact the leg and be uncomfortable to the wearer. Also, as dress lengths changed, the upper portions of hosiery, top bands could be unsightly, along with the garter belt fasteners. To eliminate these problems, pantyhose were created which use nylon or nylon-like fabrics with the leg stockings being combined with a panty in a unitary construction, eliminating the use of a garter belt to provide the support for the stockings. However, pantyhose can also be uncomfortable for the wearer, especially if worn over an extended period of time. One of the advantages of pantyhose, however, was that as fashion changes and lengths of women's dresses changes, the stocking lengths went all the way up to the panty area and were therefore not visually unattractive.

In U.S. Pat. No. 5,027,441, ladies' stockings are shown with a support connected to the front, while the stockings are somewhat obliquely cut (at the opening) from the central axis so that each stocking is longer in the front than in the back. These stockings are expensive to manufacture. Also, they do not provide the proper dimensional length for support with all types of dress lengths and therefore suffer from the same problems as previous garter belt support systems. Also, when the wearer sits, the hose tend to pull down at the back of the leg, causing discomfort upon walking. U.S. Pat. No. 3,529,329, issued to Burleson on Sep. 22, 1970, shows a fastener that is used to connect ladies' hosiery to girdles or other forms of support garments. U.S. Pat. No. 4,424,596, issued to Jackson on Jan. 10, 1984, shows a therapeutic stocking structure with a belt structure that connects along the sides of stockings. U.S. Pat. No. 3,501,774, issued to Norman on Mar. 24, 1970, shows a combination of a girdle and garter connection to use for hosiery supports. U.S. Pat. No. 3,625,029, issued to Safrit et al. on Dec. 7, 1971, includes a discussion and use of a "elastic yarn," which means any yarn having an inherent capacity to elongate under tension and having an inherent tendency to contract from an elongated condition with a degree of power in contraction. Such yarns include rubber and spandex yarns, both bare and covered. U.S. Pat. No. 3,469,583 issued to Gottlieb on Sep. 30, 1969, shows a combination girdle/stocking that has a plurality of fasteners using either hooks or buttons for supporting the hose. U.S. Pat. No. 3,487,473, issued to Jahnsen on Jan. 6, 1970, shows a combination of hose and a panty garment that has fasteners wherein the hose are sufficient length to be pulled over the wearer's hips. U.S. Pat. No. 3,566,411 issued to Gordon on Mar. 2, 1971, again shows a combination of pantyhose and hose construction for connecting the hose to the panty garment using a plurality of fasteners. U.S. Pat. No. 3,516,266 shows a circular knit stocking with integral garter loops that are connected along the top of the stocking for attachment to a garter belt and fastener around its edges. U.S. Pat. No. 3,362,029 issued to Comerma on Jan. 9, 1968, shows ladies' seamless sheer stockings which are adapted to completely cover the legs of the wearer and include a support device on the upper ends for encircling the lower trunk portion of the body. U.S. Pat. No. 3,440,665 issued to Russell on Apr. 29, 1969, shows women's hosiery composed of a pair of hip high stockings with front and rear hook members for supporting the stockings.

A review of the prior art shows that, the fasteners and fastener locations when using a garter belt structure, still create discomfort, especially for an extended time period wear of the hosiery.

The primary purpose of the present invention is to overcome these problems, especially with either a garter belt or pantyhose, that cause extended wear discomfort without increasing manufacturing costs. In the present invention, two separate hosiery legs are permanently affixed to a garter belt at a single point on each side in the hip area for support, while utilizing elongated hosiery. Each extends all the way up the legs on the inside to the crotch area with a normal opening cut. The stockings may be manufactured with two different yarns, either all nylon or a nylon and spandex combination which allows for stretch with memory. One of the primary advantages of the present invention by having a single affixing point on each side of the garter belt at the hip area is that it allows the body freedom from tight clothing, the elimination of stress points, allowing the body to move while the hosiery stays in place. Sitting or kneeling stretches regular hose to 20% to 40% from the waist to the back of the knee, resulting in sagging, yet pinching toes. With the present invention, there is no fabric across the body torso so that each hose can stay in place. From an economical standpoint, the extra material used in pantyhose is eliminated while if a run develops in one of the stockings, you need only change one hose. The actual hose can be constructed and look completely normal as long stockings with a normal looking top that is not cut at an extreme, oblique angle relative to the central axis of the stocking. This allows for standard machinery for manufacturing the hose without additional sewing at the top of the garment. For example, as shown in U.S. Pat. No. 5,027,441 issued to Wilson on Jul. 2, 1991, the tops of the stockings are triangularly shaped and obliquely cut relative to the central longitudinal axis of the hose, again requiring additional expense and custom machinery.

The present invention envisions fabric of denier 10–70, preferably 10–20, with the stretchability of nylon or nylon and spandex material, sized in length to reach the crotch of the wearer while sufficiently stretchable on the outside (hip side) for stretchable support by a single affixing point on each side near the hip area. Each stocking has a normal cut at the top opening and is affixed to the outside, hip area of each side of the belt by conventional stitching. Thus, the problems presented in prior ladies' stockings and hosiery support with fasteners that are positioned at different locations around each leg which are either unsightly with short dresses and provide pressure discomfort are eliminated. Since the stockings stretch all the way up the leg, the length of the woman's dress does not provide for unsightly situations even though a garter-like belt, with only one point of connection on each hip, is being used.

SUMMARY OF THE INVENTION

This invention comprises full length women's stockings made of a stretchable material such as nylon or nylon and a spandex yarn, sized in length to reach the full length of a woman's leg measured from the leg inside up to the crotch, each stocking having a conventional cut opening in combination with a garter belt that has one single affixing point for each stocking in the hip area of the wearer to support each stocking. The outside stocking area is stretched in the hip area and is permanently affixed, by stitching, to the outside, hip portion of the garter belt. Each stocking has a conventional yet elongated overall configuration so that it can fit on either leg and has a normal edge and shape along the top opening that in effect is perpendicular to the longitudinal axis of the primary portion of the stocking body. The top edge opening of each stocking includes a very small elastic cuff that is sewn at the top annularly around the opening. The narrow cuff or band allows the elongated stocking to be sheer up to the cuff and is used to hold the very top opening of the stocking close to the body since the body of the stocking is made of a stretchable fabric.

The garter belt portion is comprised of a conventional lace garter belt with a conventional buckle at front and back to allow for removal of one stocking-belt portion. The outside top area of each stocking engages the outside torso portion of the garter belt near the hip via conventional stitching.

Of strategic importance in the operation of the invention is the elongated length of the stocking, and the natural stretchability and memory of the fabric material used in the hose body, such as nylon or nylon and spandex yarn, which allows the hose to stretch on the outside of the leg near the hip area while remaining close and comfortable up to the crotch area on the inside of the leg so that no extended garters are employed. Traditional garters hang several inches from the belt. Applicant has found that using a nylon or nylon and spandex stretch-like material for the stocking body in conjunction with the small elastic area around the top and a single affixing point on each side of the body area in the hip area allows for full length stockings which are sized to reach from the crotch area on the inside of the leg to the heel to be comfortably worn as a full length stocking without the cutting of the stockings' top opening on an angle for attachment in the hip area.

The construction of the stocking body is conventional except that it is elongated to the crotch, has a small top band (elastic-like), and comprises stitching which affixes the stocking to the support belt. Each stocking can use conventional machines while constructing the hose. Extra material is not wasted by having angular or V-shaped portions at the top opening of the hose. Instead, the stocking opening is normal in construction and therefore, very economical in terms of the manufacture of the hose.

The stocking stretches upward on the outside but with memory so that each hose body itself along the upper opening surrounds the leg from the inside crotch area upwardly to the hip area, resulting in a full length stocking on each side of the wearer. It has been determined that the utilization of the present invention is extremely comfortable, especially for extended wear. The stockings cover the full length of the legs regardless of the dress length being utilized by the wearer, thereby permitting very short skirts. The connection of the hose to the belt is at the hip, in close proximity to the hip joint, thus allowing the hose to move in natural harmony with leg movement and therefore minimizing (even eliminating) the tension that is normally increased with sitting or kneeling when wearing traditional garter belts or pantyhose.

As the invention is envisioned, each hose is of an elongated length compared with mid-length hose sizes, with the invention using hose that reach up to the crotch area and which will be sold in various sizes, perhaps five, for different sized women.

One of the important features of this invention is that each stocking or hose and its corresponding garter belt portion is completely separate from another hose-garter belt portion. Therefore, if one stocking becomes torn or dirty, the wearer can simply unbuckle the portion of the garter belt affixed to the soiled stocking, replace the garter belt-stocking combination with a new belt-stocking portion, and re-fasten it to the other belt-stocking portion.

Another advantage of this invention is that it enables the wearer to sit while putting on hose, an important point for those with balance problems, which is not available with pantyhose. It is believed that the configuration of support and elongated hose, as disclosed in the invention, are healthier for the body than conventional pantyhose because of the overall circulation provided and comfort level. From an aesthetic viewpoint, the present invention can use stockings that are sheer all the way to the waist or inside crotch area, which requires no specific or elongated reinforcement areas except for a very small top cuff edge of approximately ¼" to ½". Many conventional stockings include very wide, several inch bands of reinforced area which destroy the sheer look and add additional discomfort.

It is an object of this invention to provide improved women's hosiery and support which include independent full length sheer stockings made of a nylon, or a nylon and spandex stretchable material to provide extended wear comfort to the user.

It is another object of this invention to provide a pair of sheer stockings supported by a unique belt or similar support that insures full length stockings without the discomfort of conventional garter belt fasteners on different areas of the leg.

It is another object of this invention to provide a pair of women's stockings that is supported to allow the body freedom from tight clothing, allows for sitting or kneeling stretching without sagging in complete extended wear comfort.

It is another object of this invention to provide an improved women's hosiery and full length stocking support for comfort and to eliminate unsightly garter belt or hose tops when using short clothing or clothing that exposes leg portions.

But yet still another object of this invention is to provide women's sheer stockings which are comfortable for extended wear and which are economical to produce, having a normal top configuration.

In accordance with these and other objects which will be apparent hereinafter, the instant invention will now become described with particular reference to the accompanying drawings.

DESCRIPTION OF THE PREFERRED EMBODIMENTS

Figure 1:
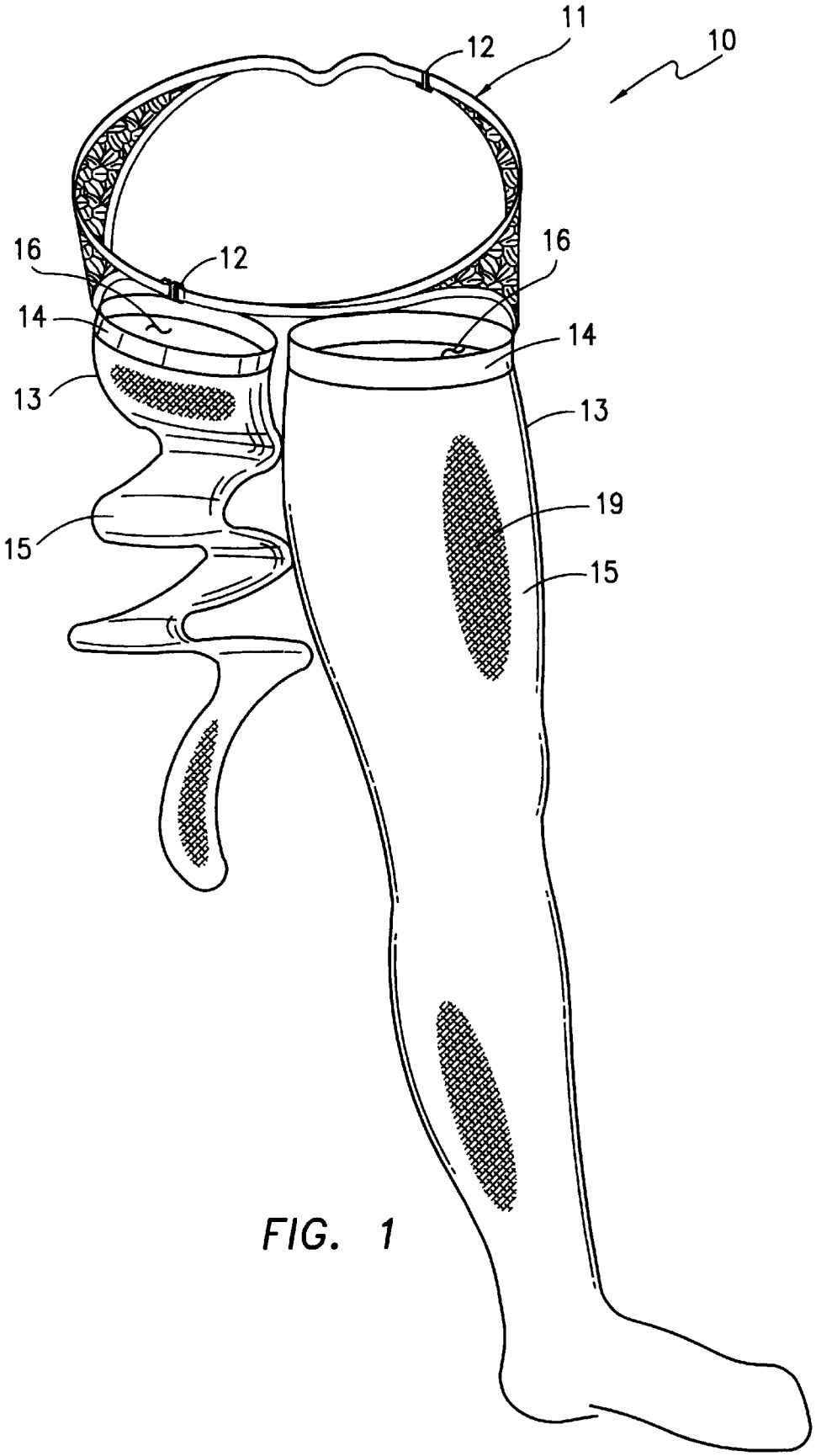
FIG. 1 shows a perspective view of the present invention in which one stocking is fully extended as if a leg were in it and another stocking is folded in conjunction with a lace garter belt support shown as if it were worn by a person.

Referring now to the drawings, and in particular FIG. 1, the present invention is shown generally at 10, comprised of an elastic, lace, waist-encircling stocking support belt 11 having a pair of waist buckles 12 for encircling and connecting the belt around the wearer's waist.

A pair of identical individual leg-encircling stockings 13, elongated to reach the wearer's crotch, are shown, each having a top band 14 used to surround the opening of the stocking. The hosiery body 15 is comprised of a nylon fabric with spandex that is stretchable and yet has memory so that it returns to its normal shape. The top band 14 could be an elastic band. As shown in FIG. 1, the normal opening 16 of each stocking is conventional, as is the entire shape of the stocking body 15 in all respects. It is preferred to be made, however, of a stretchable nylon or nylon and spandex material for the purposes of this invention. However, nylon can be used since it has some stretchability and memory, or other nylon-like materials.

Figure 2:
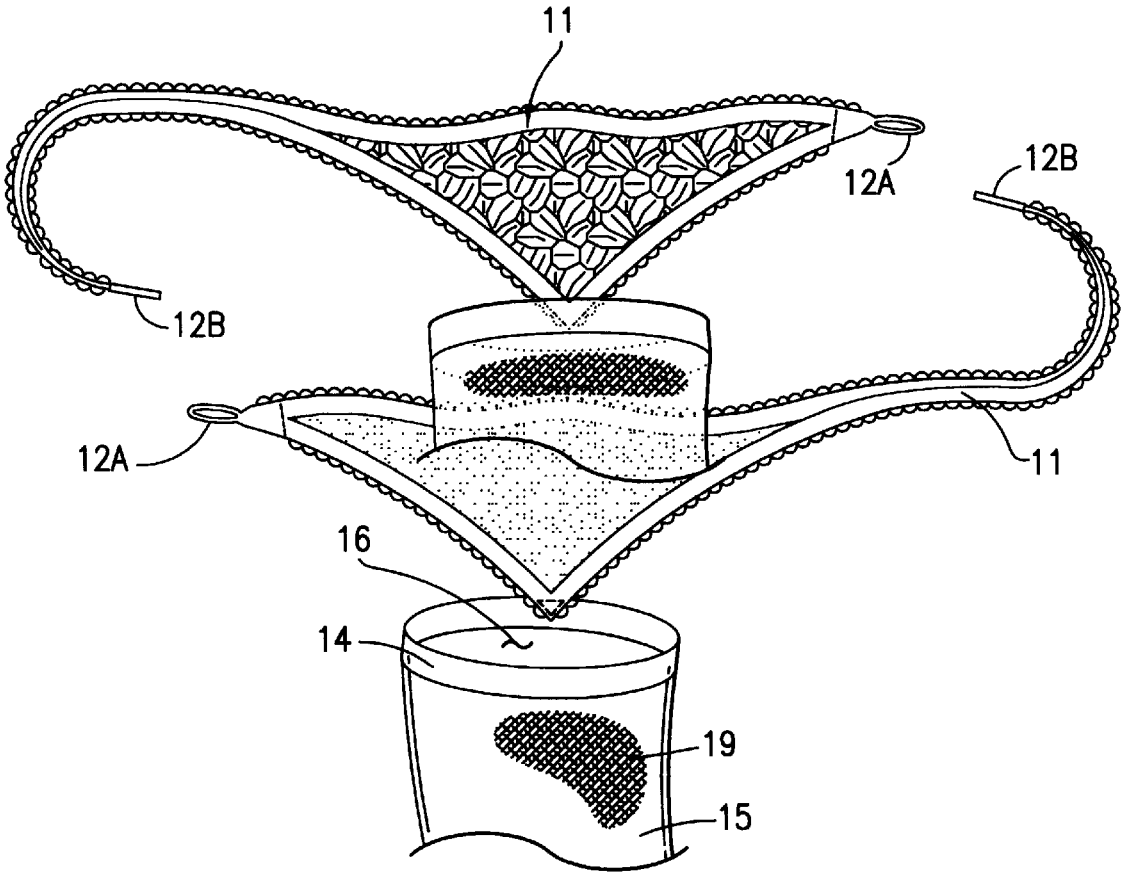
FIG. 2 depicts a side, exploded view of the garter belt-stocking combination showing the stocking affixed at one point to each garter belt portion.

Referring to FIG. 2, the single upper band 14 defining the opening of the stocking, shows an affixing point stitched to belt 11 in the hip area. This is the only and single support of the entire stocking on one leg. However, because of the stretchability of the stocking material, the stocking will be sized in length to fit from the inside crotch of the wearer while stretching on the outside hip area when in use. The outside stretch area is not severe or extreme enough to overtax the memory of the fabric or cause discomfort. The buckle 12 is seen to comprise two portions; a loop portion 12A and a hook portion 12B. Although the loop-hook configuration is shown, any fastening means could be used.

Figure 3:
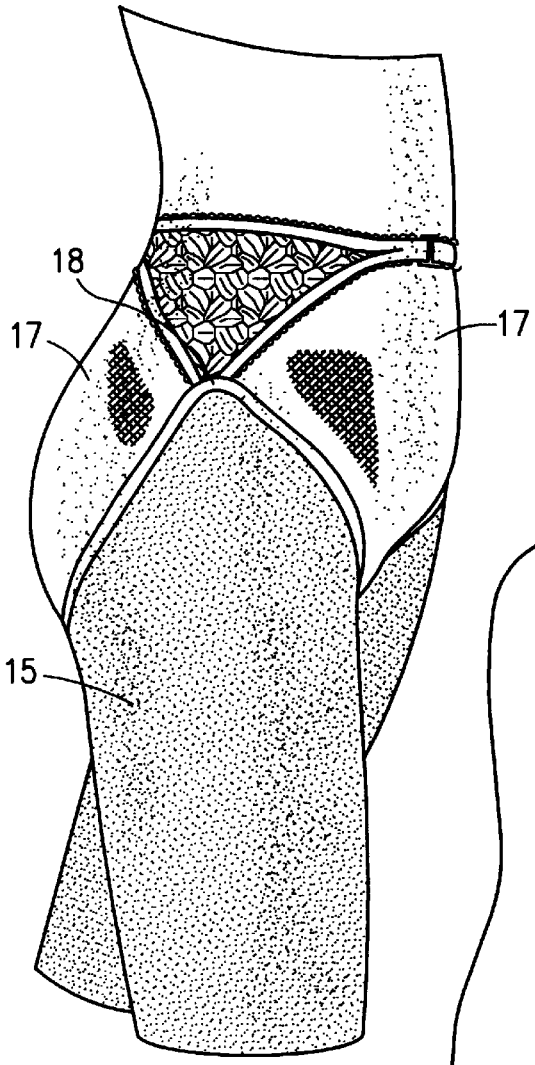
FIG. 3 shows a perspective, side view of the present invention as used on the torso of a person.

Referring now to FIG. 3, the invention is shown as would be in use with the belt 11 encompassing the torso of the wearer who could also be wearing an undergarment 17. The outer portion of the stocking is affixed at one affixing point 18 allowing the stocking to extend much higher up the hip area than the inside portion along the inner crotch area. This is because the body of the stocking 15, comprised of fabric 19, is stretchable and extends up on the side portions while remaining comfortable throughout the entire leg area. Note that the affixing point 18 resides in the hip area only, with no other straps or fasteners impeding the use of the garment.

Figure 4:
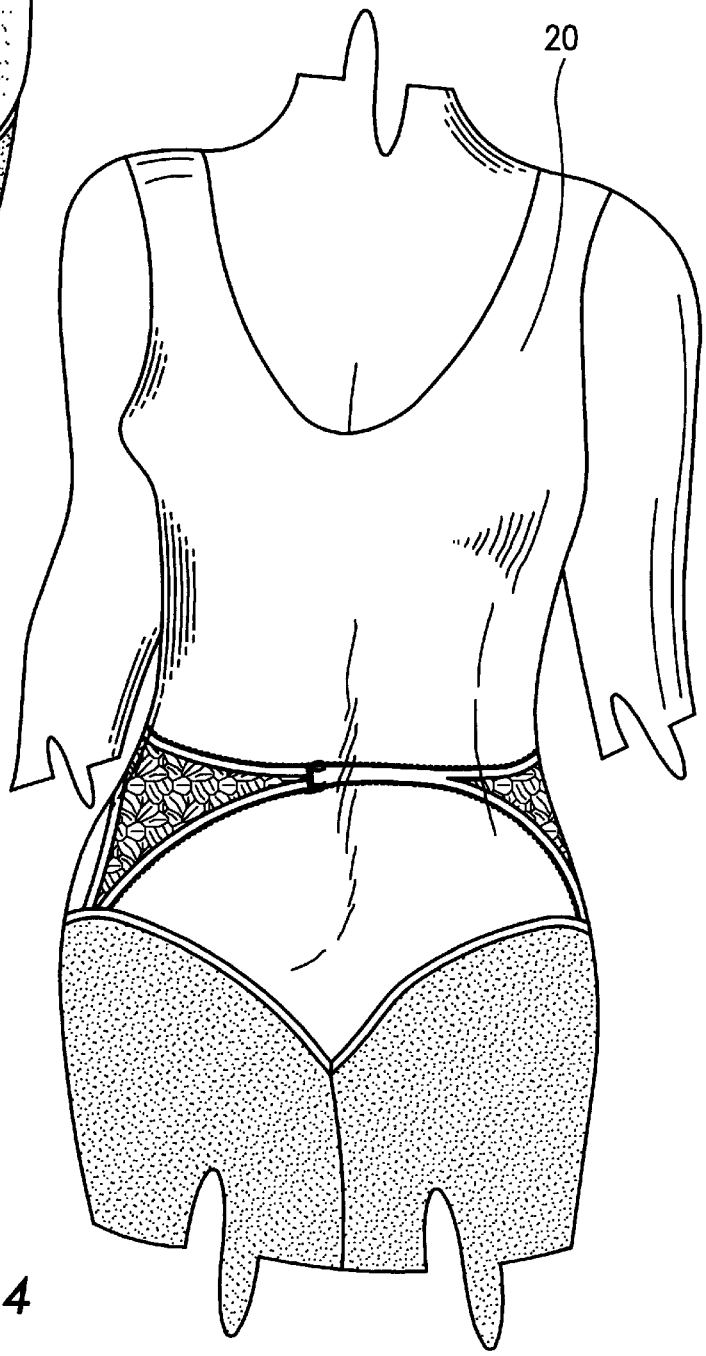
FIG. 4 shows a perspective, front view of the present invention as used on the torso of a person.

FIG. 4 shows a full body suit 20, which is completely compatible with the present invention. Again, the stockings used herein are of a normal configuration and will not require any alteration in the equipment for manufacturing the stockings. The use of spandex fibers will provide for great stretch action, allowing the hip area to be drawn up to the fastener with the other area remaining comfortably in the crotch area. Other garments such as a tank top can be utilized in conjunction with the present invention.

All of the hose and support garments as shown provide for extended longer comfort throughout the day without intrusion by straps or fasteners on the leg areas which can cause discomfort and without the discomfort of wearing tight pantyhose for long periods of time. The stocking configuration, although elongated, is of normal cut and does not require extensive or expensive modification of equipment for manufacturing the hose garments.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A stocking and support, comprising:

a pair of full length stockings made of a stretchable material; and a garter belt that encircles a wearer, said garter belt including two triangular-shaped panels each having two outside points and a lower point, said belt having only two affixing points, one on each hip area at each said lower triangular point, said belt is permanently affixed via affixing means at each said triangular point to an outside portion of each stocking near a top opening edge of the stocking, whereby said stockings are stretched full length from the foot to the inner crotch and to the outside hip area of the wearer.

2. A woman's stocking and support as in claim 1, wherein said full length stockings being made substantially of a sheer material, stretchable with memory.

3. A woman's stocking and support as in claim 1, wherein said full length stockings are made of a sheer, stretchable material that includes a spandex material.

4. A woman's stocking and support as in claim 2, wherein said stockings include a narrow cuff.

5. A woman's stocking and support as in claim 1, wherein said affixing means comprise stitching.

6. A woman's stocking and support as in claim 1, wherein said garter belt includes a buckle at said belt's front portion and back portion.

7. A woman's stocking and support as in claim 2, wherein said full length stockings are made of nylon.

* * * * *

UNITED STATES PATENT AND TRADEMARK OFFICE

CERTIFICATE OF CORRECTION

PATENT NO. : 6,101,635

DATED : August 15, 2000

INVENTOR(S) : Jones, Alma

It is certified that error appears in the above-identified patent and that said Letters Patent is hereby corrected as shown below:

Title page, item [73] Assignee: Cherie Rossetti

Signed and Sealed this

First Day of May, 2001

*Attest:*

Nicholas P. Godici

NICHOLAS P. GODICI

*Attesting Officer*

*Acting Director of the United States Patent and Trademark Office*